US005678723A

United States Patent [19]

Swift et al.

[11] Patent Number: 5,678,723

[45] Date of Patent: Oct. 21, 1997

[54] ROLLED BAG DISPENSING WASTE RECEPTACLE

[76] Inventors: Daniel P. Swift, 1918 Curtis, Laramie, Wyo. 82070; Robert W. Saathoff, 0571 Cty Rd. 130, Glenwood Spgs., Colo. 81601; Thomas R. LaCroix, 244 E. Fallen Rock, Grand Jct, Colo. 81501; William E. Bullock, P.O. Box 1328, Colenwood Springs, Colo. 81602

[21] Appl. No.: 572,006

[22] Filed: Dec. 14, 1995

[51] Int. Cl.[6] ..... B65F 1/06

[52] U.S. Cl. ..... 220/407; 220/908; 220/789

[58] Field of Search ..... 220/407, 908, 220/789, 788

[56] References Cited

U.S. PATENT DOCUMENTS

| | | | |
|---|---|---|---|
| 2,878,848 | 3/1959 | Coltman, Jr. | 220/789 |
| 3,451,453 | 6/1969 | Heck . | |
| 4,319,694 | 3/1982 | Nehrbass et al. | 220/407 |
| 4,349,123 | 9/1982 | Yang | 220/407 |
| 4,373,642 | 2/1983 | Wolters et al. | 220/788 |
| 4,682,707 | 7/1987 | Wiles | 220/789 |
| 4,721,226 | 1/1988 | Yurko . | |
| 4,823,979 | 4/1989 | Clark, Jr. . | |
| 4,887,735 | 12/1989 | Dudzik | 220/789 |
| 5,031,793 | 7/1991 | Chen et al. . | |
| 5,372,272 | 12/1994 | Jennings . | |
| 5,582,317 | 12/1996 | Wermund | 220/789 |

*Primary Examiner*—Stephen J. Castellano

[57] ABSTRACT

This invention discloses waste receptacles comprising a waste receiving chamber and a bag storing chamber, which is defined by generally planar ends and a tubular or cylindrical shaped bottom meant to hold rolls of plastic liner bags where preferably the bags are joined by perforated seams. The bag roll chamber may be integrated into the bottom of the waste receiving chamber with a plate fastened over the chamber to confine the bag roll. It may appear as a removable tray or chamber under the waste receiving chamber or in another embodiment appear to the side and at the bottom of the waste chamber. In all cases, the bag roll chamber will accommodate any size roll for that particular size of waste receptacle, and will continue to center, hold, and feed bags from the roll even as the roll decreases in diameter as bags are used.

3 Claims, 6 Drawing Sheets

ROLLED BAG DISPENSING WASTE RECEPTACLE

BACKGROUND OF THE INVENTION

1. Field of the Invention

This invention relates to waste receptacles, particularly to such receptacles with provisions for storing and dispensing disposable plastic bags or liners, and more particularly to those type of bags that are stored and sold in rolls and which are connected by perforations and are separated by tearing the bags apart at the perforations. The invention is comprised of a waste chamber with a partially tubular chamber below or to the side of the waste chamber bottom so that the mass of waste is supported by the waste chamber bottom.

2. Description of the Prior Art

It is common practice to provide waste receptacles with disposable liners so that when the waste container is full, the liner can be removed and a new liner installed making the waste receptacle clean and ready for reuse. The bags are usually obtained either in perforated rolls where the bags are separated by tearing along the perforations or in boxes where they are inter-folded so that when one is removed another is pulled up and ready to grab. The thin plastic liners are usually supplied in boxes when not connected by perforations and either in boxes or plastic bags when supplied in perforated rolls.

Previous attempts have been made to provide a waste receptacle with provision for storing and dispensing plastic bag liners. Some designs provide for exterior openings for inserting the bags, and some of the dispensing methods are too complicated for economical and massive distribution. An even broader disadvantage is inherent in the prior art. It has been proposed to provide a void in the bottom of a waste receptacle to contain a boxed supply of bags. This requires that a separate floor be provided for the waste receptacle to hold the mass of waste material above the box of plastic liners to prevent crushing of the box. U.S. Pat. No. 5,372,272 to Jennings illustrates these limitations. It can also be noted that for plastic bags supplied in boxes, the boxes will be of different sizes. This requires that a waste receptacle with a compartment for boxed bags must either be provided with compartments of different sizes or of sufficient size to accommodate the largest practical box, possibly making the waste receptacle too large for standard use. A smaller box of liners fitted in an oversized compartment will tend to shift and make the bag feeding aperture in the box difficult to reach to extract another bag. U.S. Pat. No. 3,451,453 to Heck presents a patent with very similar limitations. Again, the receptacle requires a separate floor to keep the refuse mass above the supply of bags with additional components that make the receptacle too expensive and inconvenient for massive use.

An additional disadvantage to dispensing bags from cardboard containers is that should any bag rupture with fluids inside, those fluids will soak into the box dispenser which will disintegrate and allow the plastic liner bags spread around the bottom of the receptacle, possibly ruining the interfolded dispensing feature of the stack.

SUMMARY OF THE INVENTION

Accordingly, the object of the present invention is to address and to correct as many of the disadvantages of the current waste receptacles with bag dispensers as is possible.

This present invention teaches improvements in waste receptacles mostly formed of molded plastics or other suitable materials, with a provision for storing and dispensing plastic liners. The improvement includes a provision for storing rolled bags in a chamber conveniently and economically provided either in the middle portion or side of the base of a waste receptacle. This invention discloses a waste receptacle comprising a waste receiving volume or portion open from the top and a tubular chamber or recess for the storing and dispensing of rolled bags, preferably connected by perforations. The present invention does not attempt to dispense unconnected bags as might be provided in cardboard boxes. The improvement includes a chamber integral with and formed into the floor of the waste receptacle, which after the roll of bags is inserted into the holding chamber, a retaining plate is snapped over the chamber to confine the roll when a bag is pulled into the waste chamber from off the roll. The chamber features more or less vertical sides transforming into a semicircular bottom which allows the roll of bags to turn in the chamber when a bag is pulled into the waste chamber. In this design, the mass of refuse is carried by the floor of receptacle and not by the light chamber restraining plate. The shape of the chamber keeps the roll of liners centered in the chamber and so under the dispensing slot. Further, as the roll diameter decreases as the bags are used, the roll remains centered and accessible in the holding chamber. The receptacle can be formed in one piece by standard molding methods and so remains economical to produce. A further advantage of the present bag holding chamber is that the chamber will accommodate all sizes of bag rolls and still keep the liners centered and in position under the dispensing slot, so that the user is not limited to a particular manufacture or size of bag rolls. Another feature of this embodiment is that the body of the waste receptacle is one Piece so that any fluid leak is confined in the receptacle body.

The present invention is designed to take advantage of perforated connected bag rolls, by freely allowing the roll to turn as a bag is pulled into position in the waste chamber, and keeping the roll in position as the diameter of the roll decreases through use. That is, when the liner bag currently lining the chamber is full and removed, the connected bag behind it is pulled into position to line the waste receptacle. The filled bag is simply torn off along the perforated line for disposal and the new bag fitted around the waste chamber walls. This relieves the user of having to bend and reach into a soiled waste receptacle to pull out a new bag and fit it. Also, should a bag leak and leave fluids in the bottom, the next bag is pulled upward through the leakage and allows the user to place the bag by handling the clean interior of the bag and not the soiled exterior.

In an alternate construction, there is provided a removable chamber in place of the bottom formed chamber described above. The chamber is comprised of two circular ends and a semicircular bottom which carries the liner bag roll. The chamber is fitted wholly below the floor of the waste receptacle and below a dispensing slot in the floor. A roll of bags is installed by sliding the chamber out from the side of the waste receptacle, placing the roll and sliding the chamber back into position. Bags are fed into the waste chamber as previously described, through a dispensing slot. In this embodiment, the floor of the waste receptacle at the dispensing slot is curved upward over the roll chamber, so forming two containment reservoirs to hold any leaked fluids, in the unlikely event a bag ruptures. The roll chamber also functions to catch and hold any fluid dripped through the dispensing slot. The chamber is easily removed and cleaned if necessary when replacing the bag rolls. Since most waste turned into receptacles is dry and moist at worst, these features are redundant protection in this embodiment.

Still a further embodiment is presented that features the roll chamber to the side of the waste receptacle walls. This configuration is more suited to small sized receptacles as might be used in automobiles where overall height is an important consideration. In this alternate construction, the bag roll chamber is composed of two ends, a semicircular bottom which blends into the bottom of the waste receptacle. The bags are fed into the waste chamber through a dispensing slot at the bottom of the side common to the waste and bag chambers. The semicircular bottom of the roll chamber also acts to confine any fluid leakage. For the intended use of this waste receptacle, this feature is also redundant protection. As is the case in the above embodiments, this receptacle can be molded in one piece by present molding techniques, making it an economical alternate to receptacles without bag dispensing features.

It is an object of the present invention to provide a waste receptacle with a bag roll dispensing feature that utilizes a simple design, so making the receptacle economical to produce of plastics such as polypropylene, polyethylene, or of other suitable materials.

It is another object of the present invention to provide a waste receptacle with a bag roll dispensing feature that does not require a separate removable refuse carrying floor to protect the bag container or supply.

It is still another object of the invention to provide a waste receptacle with a bag roll dispensing feature so that the chamber shape allows the bag roll to freely turn and will accommodate any size of bag roll and keep the roll in position under the dispensing slot.

It is yet another object of the present invention to provide a waste receptacle with a bag roll dispensing feature so that when a filled bag is removed the next bag is pulled into position so that the user is not required to reach into the waste receptacle to remove and replace the new bag. It is yet another object of the present invention to provide a waste receptacle with a bag roll dispensing feature so that the bag roll chamber may be removed from the side for ease of roll replacement.

It is yet another object of the current invention to provide a waste receptacle with a bag roll dispensing feature that is removable from the side, and the bottom of the waste receptacle is shaped to contain leaked fluids and the chamber is positioned to receive any dripped fluids.

It is yet another object of the present invention to provide a waste receptacle with a bag roll dispensing feature so that the bag dispensing chamber can be positioned on the side to minimize the receptacle height for use in confined spaces.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
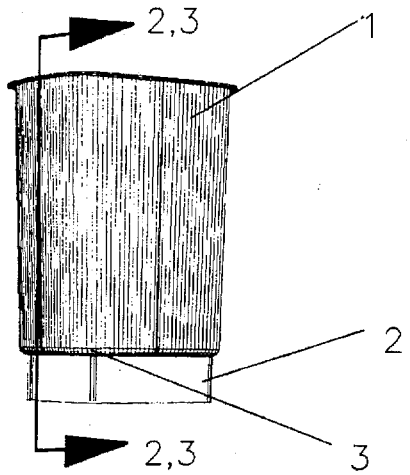
FIG. 1 is an exterior perspective view of a waste receptacle with a bag roll dispensing feature.
Figure 2:
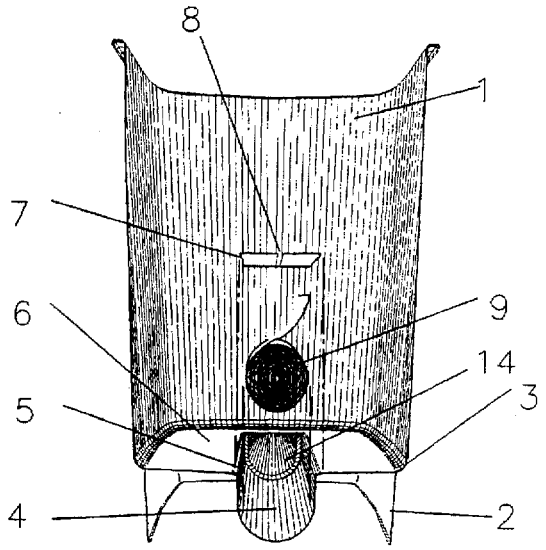
FIG. 2 is a cross section exploded perspective cut according to FIG. 1 showing the retaining plate, roll chamber, and roll of liners.
Figure 3:
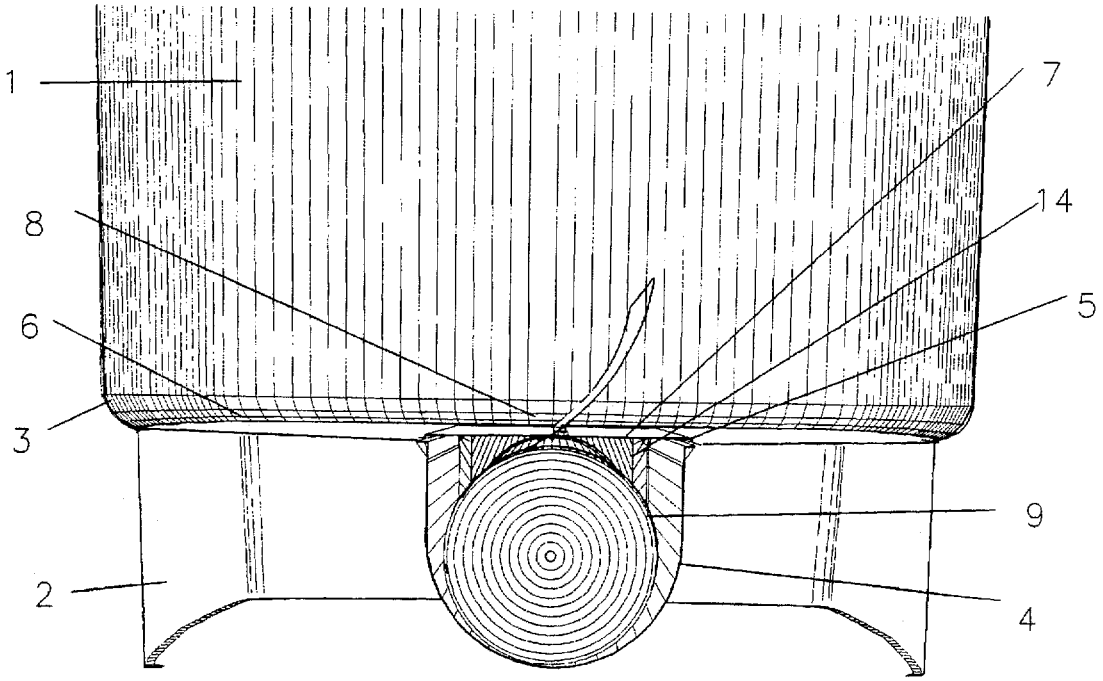
FIG. 3 is a cross section assembled perspective cut according to FIG. 1 showing the bag roll and retaining plate in place.
Figure 4:
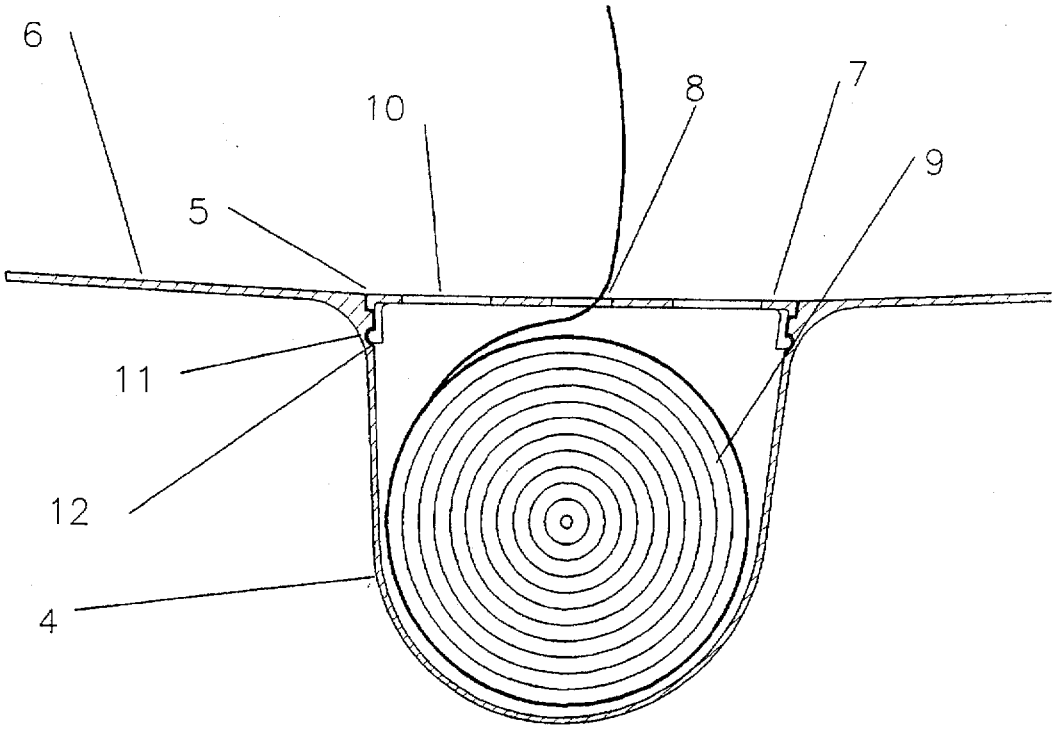
FIG. 4 is a cross section similar to FIG. 3 detailing the method of clipping the retaining plate onto the bag chamber.
Figure 5:
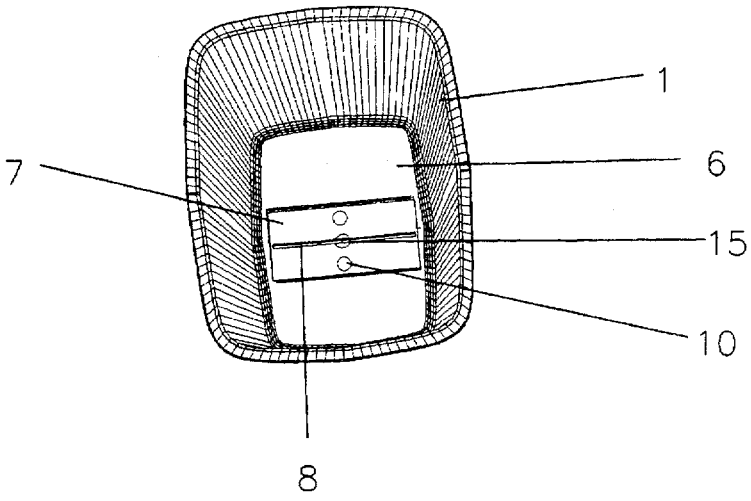
FIG. 5 is an aerial view of the waste receptacle showing the retaining plate.

A typical waste receptacle with an interior bag roll dispensing feature is illustrated in FIG. 1. The receptacle is comprised of a refuse holding chamber 1 formed into a bottom shoulder 2 where the waste chamber walls form to the waste chamber bottom. A lower skirt 3 provides space to house the bag dispensing chamber. Considering FIG. 2 it can be seen that the bag dispensing chamber is composed of a curved bottom 4 forming into straight sides which connect to the waste chamber bottom 6 and form a bearing ledge 5 to receive the retaining plate 7 which includes a dispensing slot 8 so that liner bags from bag roll 9 may feed into the waste chamber 1. Refuse mass is substantially borne by the floor plate 6. Curved chamber bottom 4 allows the bag roll 9 to freely rotate as bags are pulled into the waste chamber, and bag roll 9 is generally held in position by chamber end wails 14. FIG. 3 offers a more detailed view of the bag roll chamber with all the components assembled. Bag roll 9 lies on the curved bottom 4 of the roll chamber. Retaining lid 7 rests on bearing ledge 5 of the roll chamber and liner bags are fed through dispensing slot 8 of the retaining lid into waste chamber 1. Floor deck 6, which carries the bulk of the waste mass is flush with the edge of retaining cover 7. The chamber is shown in even greater detail in FIG. 4. In addition to the above described features, finger holes 10 are shown which allow the user to insert the fingers and unsnap and remove the retaining plate 7 from the roll chamber. The retaining plate 7 is held in place by a flexible tab and roll 11 which engages a retaining slot 12 cast into the wall of the roll chamber. FIG. 5 shows the retaining lid 7 in place inside the waste chamber 1 and more clearly shows the finger holes 10, an aid in removing the retaining plate. An additional hole 15 in the dispensing slot 8 is provided as an aid in reaching the leading edge of the top bag on the roll to pull it through into the waste chamber.

Figure 6:
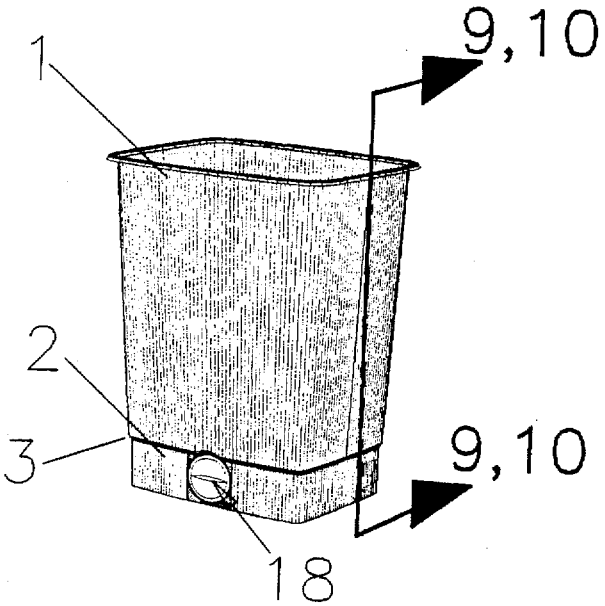
FIG. 6 is an exterior perspective view of a waste receptacle with a bag roll dispensing feature removable from the side.
Figure 7:
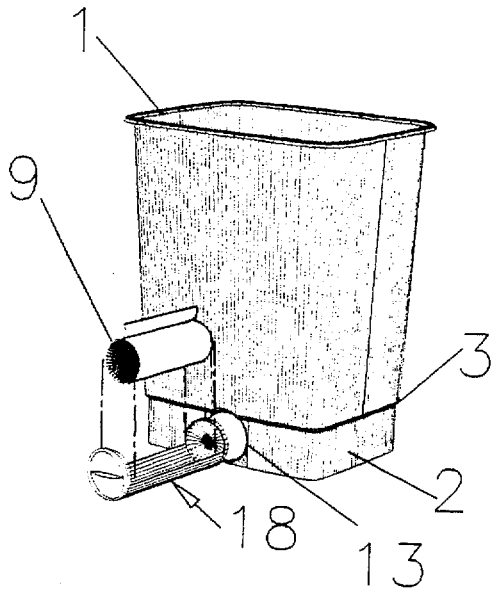
FIG. 7 is an exterior exploded view similar to FIG. 6 showing the roll chamber and liner roll.
Figure 8:
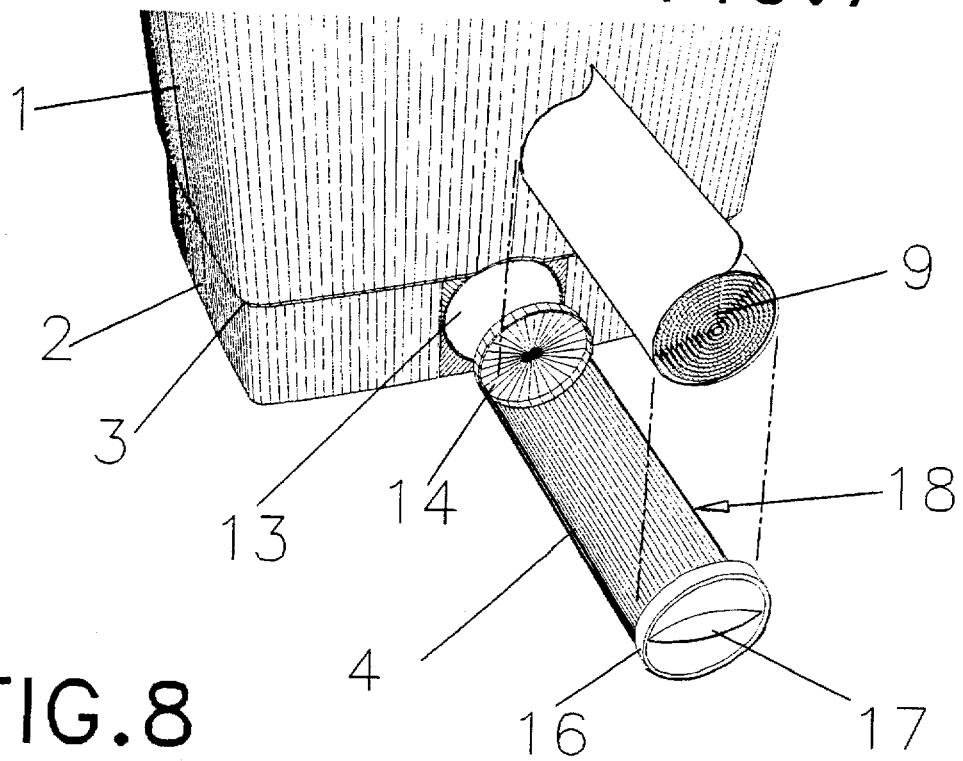
FIG. 8 is a detailed perspective view similar to FIG. 7.
Figure 9:
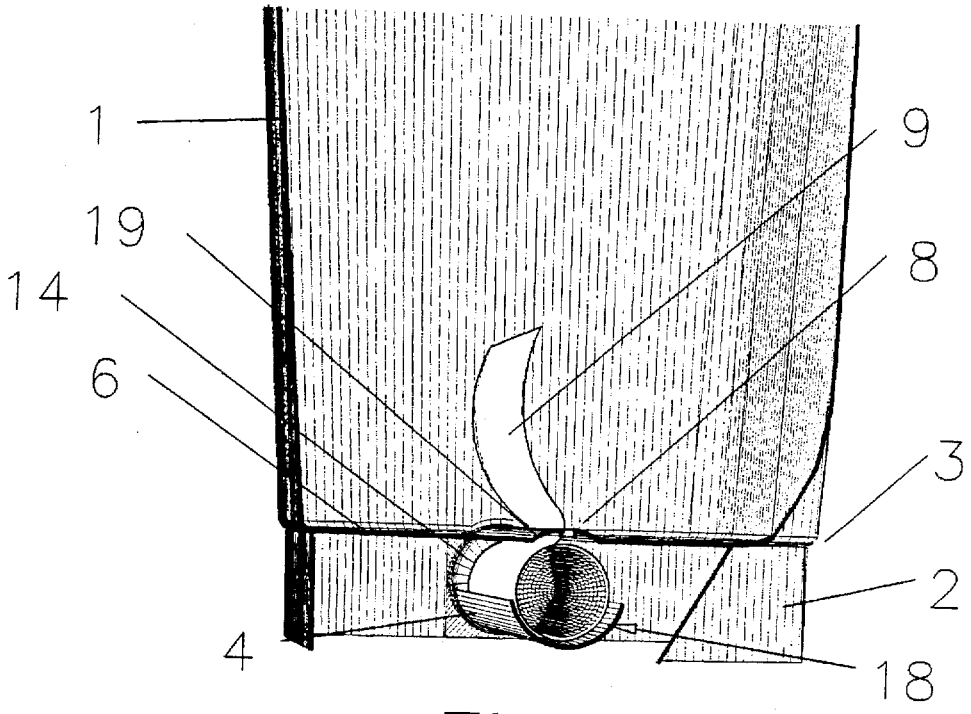
FIG. 9 is a cross sectional perspective view cut according to FIG. 6 showing the liner roll and roll chamber in place.
Figure 10:
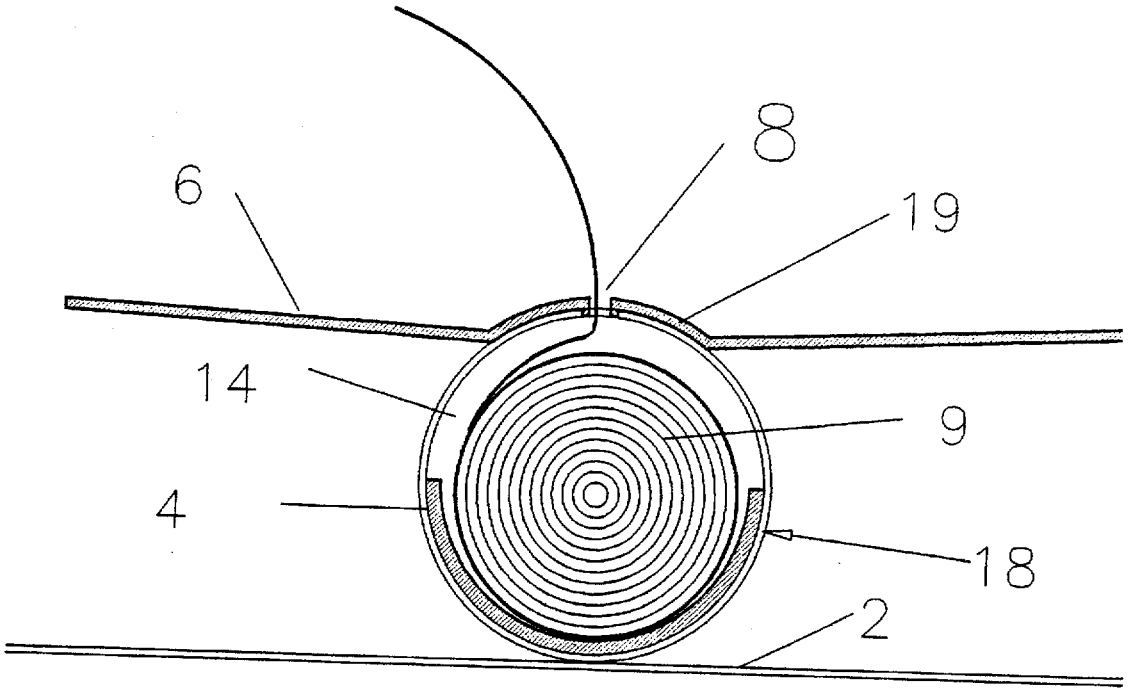
FIG. 10 is a detailed cross sectional view cut according to FIG. 6.

A different embodiment is shown in FIG. 6 which features a waste chamber 1 formed of walls and a bottom which forms along bottom shoulder 3. Below the bottom is a lower skirt 2 that provides the receiving means for a removable roll chamber assembly 18. FIG. 7 is a perspective view similar to FIG. 6 with the roll chamber assembly 18 retracted from receiving throat 13 and receiving bag roll 9. Referring to the more detailed drawing FIG. 8 it can be seen that roll chamber assembly 18 is further composed of end walls 14, a cylindrical chamber bottom 4, an end panel recess 16 with handle 17. The roll chamber assembly is placed into and removed from the receiving throat 13 by use of the handle 17. The roll chamber is slid through the receiving throat 13 until it engages a similar throat on the opposite side of the lower skirt where the roll chamber is seated into place, centrally located under a dispensing slot in the floor of the waste chamber. This is observed in FIG. 9 where the chamber is in place and a liner bag from bag roll 9 is fed through dispensing slot 8. A curved plate 19 formed into the bottom elevates the dispensing slot 8 above the general bottom plate 6 which creates two fluid reservoirs 22 at each side of the roll chamber 18 and dispensing slot 8 to catch any fluids should the current liner bag rupture. In addition to the reservoirs 22, the end walls 14 and chamber bottom 4 form a leak proof tray under the dispensing slot 8 that is positioned to catch any overflow from reservoirs 21 or drips from bag ruptures. Roll chamber 18 may be easily removed for cleaning. FIG. 10 is a cross section more fully illustrating the above described elements, features, and enhancements.

Figure 11:
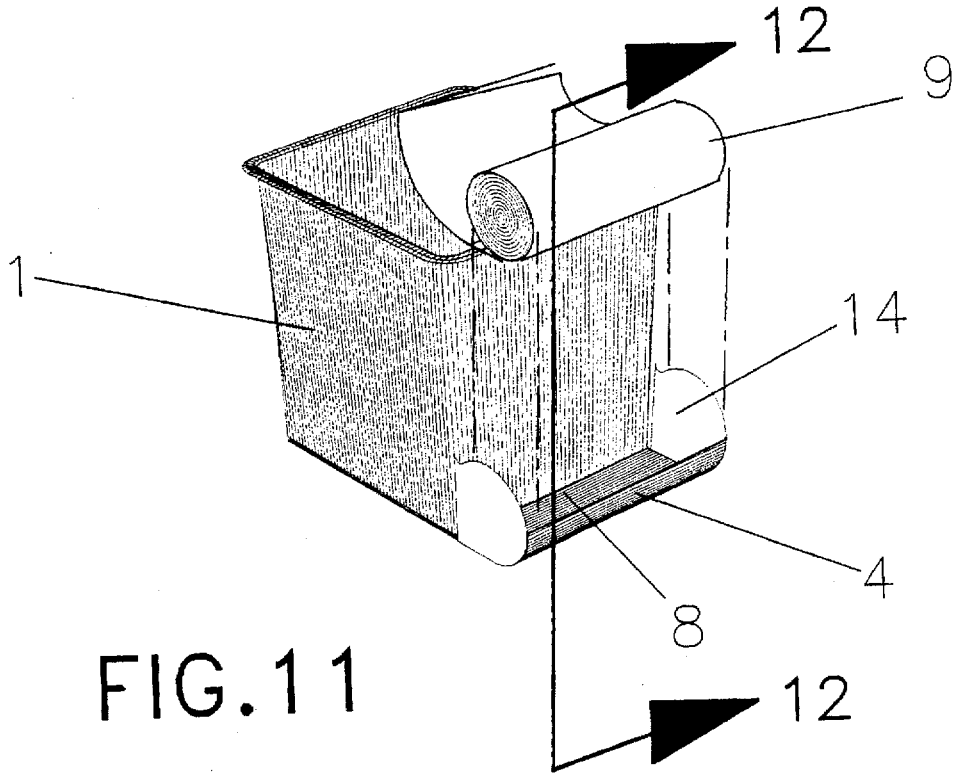
FIG. 11 is an exterior view of a waste receptacle with a bag roll dispensing feature to the side of the waste receptacle.
Figure 12:
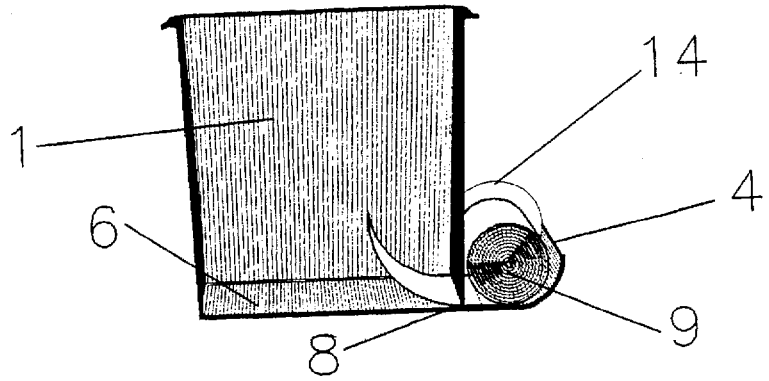
FIG. 12 is a perspective section cut according to FIG. 11 showing the liner roll in place.

An additional embodiment is presented in FIG. 11. In this design, the roll chamber is featured on the exterior and lower side of the waste chamber 1. As can be seen, liner roll 9 sets into a roll chamber comprised of a curved bottom plate 4 and end walls 14. The leading edge of the first bag is fed through dispensing slot 8 at the bottom of the common wall of waste chamber 1 and the roll chamber. This is more clearly shown in the cross sectional FIG. 12. This embodiment is more suitable for smaller and more compact waste receptacles as might be used in automobiles.

Figure 13:
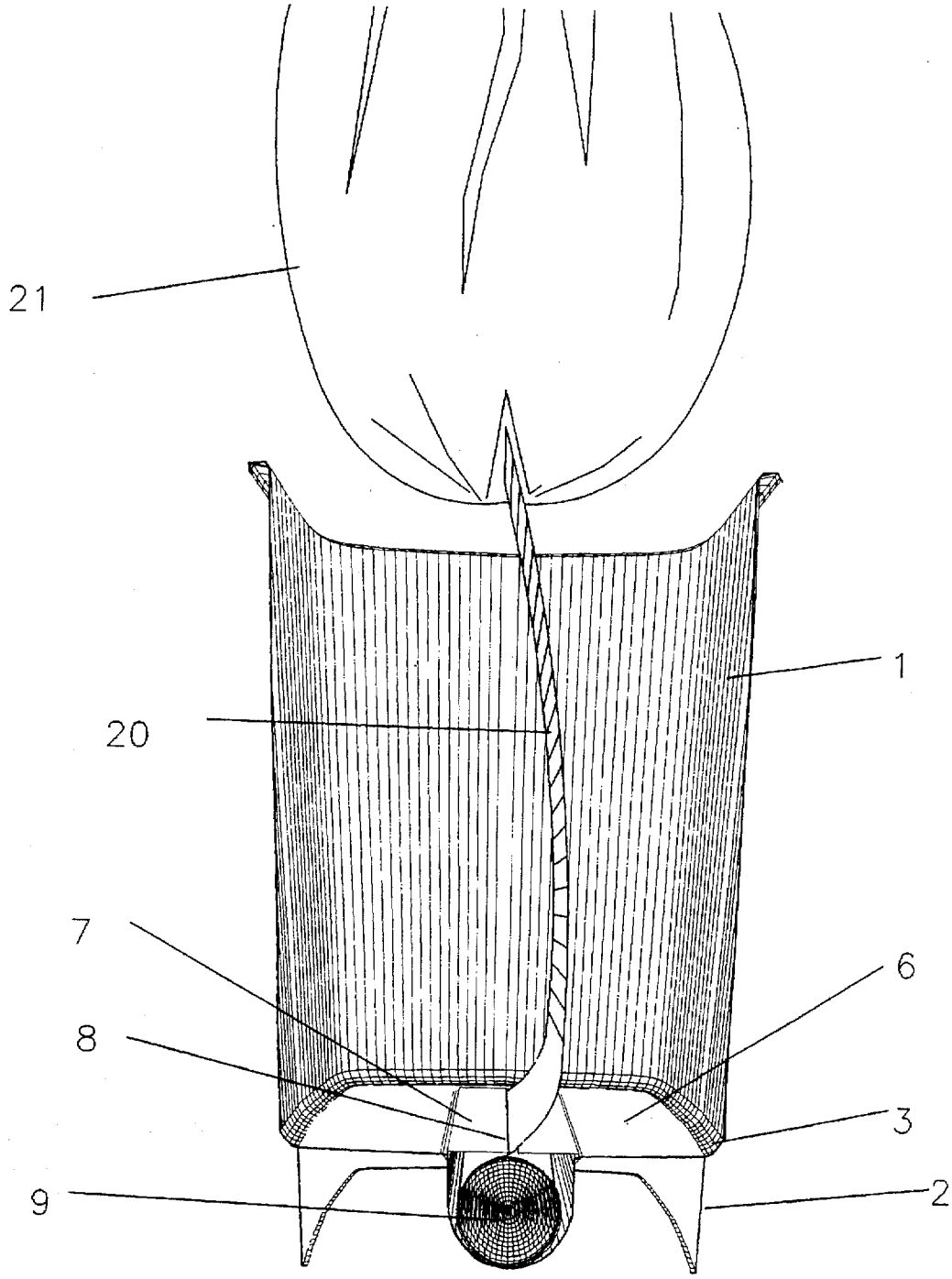
FIG. 13 is a perspective section similar to FIG. 2 showing a liner being removed and the next liner being automatically pulled into position for placement.

FIG. 13 is an illustration of a great advantage of the present invention. Bag rolls with perforated connections between bags are chosen as the dispensing medium, and the bag chamber configurations are set to accommodate these rolls. As is shown, A filled liner bag is withdrawn from the waste chamber 1. The next bag on bag roll 9 is pulled through dispensing slot 8 into the waste chamber. As the filled bag 21 is pulled clear of the waste chamber the trailing unfolded bag 20 is ripped from bag 21 at the connecting perforations. Bag 21 is discarded and bag 20 is pulled into the waste chamber just until the perforated seam between bags is through dispensing slot 8. The new bag is spread around the edges of the waste chamber to receive waste. When filled, the cycle is repeated with the next bag automatically pulled into place.

Although the description above contains many specificities, these should not be construed as limiting the scope of the invention but as merely providing illustrations of some of the presently preferred embodiments of the invention. For example, where the dispensing slot is elevated above the waste receptacle bottom by a curved plate that plate be of different shape. Or where the wall extension of the waste receptacle below the receptacle bottom is shown as solid that skirt may be perforated or consisting of fewer sides.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

Thus the scope of the invention should be determined by the appended claims and their legal equivalents, rather than by the examples given.

What is claimed is:

1. A waste receptacle comprising an open top receptacle having generally upstanding sidewall or walls and a bottom wall, said sidewalls extending a vertical distance below said bottom wall forming a pedestal, said bottom wall containing a depending bin for storage of a roll of end-to-end connected bags, which are used individually for lining the interior of the receptacle, said bottom wall containing a generally rectangular-shaped opening through which a roll of bags can be inserted into the bin, wherein said bottom wall has a recessed shelf portion surrounding the opening therethrough, said recessed shelf potion being adapted to snugly receive a bin cover, and the bin having generally straight bin walls and a cylindrical bottom on which the inserted roll of bags rests with its longitudinal axis generally parallel to longitudinal axis of said bin, and said straight bin walls and said cylindrical bottom extending to and terminating at said sidewalls extending below said bottom wall, said straight bin walls having a groove on the interior face at a position near said opening in said bottom wall and a bin cover for closing and opening said opening and whose dimensions exceed those of the opening in the bottom wall of the receptacle which it closes, said bin cover containing a slot through which one end of a roll of bags is guided into the interior of the receptacle, the bin cover having tabs along its corresponding sides extending from the underside and located to pass along the inside faces of said straight bin walls and said groove, said tabs having a boss on the face so as to engage said groove on the inside face of said straight bin walls thus releasably locking said bin cover in closed position over said opening.

2. A waste receptacle as claimed in claim 1 wherein the bin cover is flush with the receptacle bottom wall and the slot therethrough is located close to the centerline of the bin cover and wherein the bin cover has finger holes by which it is grasped to overcome the frictional catch and permit the bin cover to be removed to accommodate insertion of a fresh roll of end-to-end connected bags into the bin.

3. A waste receptacle as claimed in claim 2 wherein the fingerholes therethrough are located along the edge of the bin cover.

* * * * *